United States Patent [19]

Laporte

[11] 4,262,808

[45] Apr. 21, 1981

[54] APPARATUS FOR STORAGE AND SELECTION OF SUSPENDED SHEETS

[76] Inventor: Joseph L. Laporte, 420 E. Principale St., Saint-Ambroise de Kildare, Quebec, Canada

[21] Appl. No.: 29,443

[22] Filed: Apr. 12, 1979

[51] Int. Cl.[3] ..... A47B 63/00; A47F 7/16

[52] U.S. Cl. ..... 211/46; 312/184; 402/47

[58] Field of Search ..... 211/46; 312/183, 184, 312/189; 402/25, 47, 80 R, 29, 42

[56] References Cited

U.S. PATENT DOCUMENTS

| | | | |
|---|---|---|---|
| 1,411,959 | 4/1922 | Day | 402/25 |
| 2,623,526 | 12/1952 | Page | 211/46 |
| 2,704,545 | 3/1955 | Page | 211/46 |
| 3,312,517 | 4/1967 | Barker | 312/184 |

FOREIGN PATENT DOCUMENTS

| | | | |
|---|---|---|---|
| 1245312 | 7/1967 | Fed. Rep. of Germany | 312/184 |
| 903214 | 8/1962 | United Kingdom | 312/184 |

*Primary Examiner*—Victor N. Sakran

[57] ABSTRACT

A storage and selection apparatus for suspended sheets such as drawings characterized by having a sturdy mechanism to assist lifting any selected stack of sheets and by having selection pins which move endwise toward the pins of the selected stack of sheets for sustained accurate alignment of the pins and reliable transfer of sheets from the pins of the selected stack to the selection pins and vice versa. This storage and selection apparatus comprises a cabinet, a pair of parallel guideways secured along opposite sides of the cabinet, and defining between them a storage space for suspended sheets, main rack bars and an elongated carriage including an elongated frame and an auxiliary rack bar extending with the main rack bars transversely of the guideways with their opposite ends displaceable along the guideways respectively; the carriage is above the main rack bars and provided with a lifting mechanism to selectively lift any main rack bar with the stack of sheets thereon, each rack bar is provided with pins to suspend the sheets, and the auxiliary rack bar is displaceable to and fro longitudinally of the guideways to reliably abut the pins thereof in endwise registry against the pins of the lifted main rack bar thereby allowing to transfer the sheets from the pins of the lifted main rack bar to the pins of the auxiliary rack bar and vice versa to insert or remove a sheet or drawing at any position in a stack.

5 Claims, 8 Drawing Figures

APPARATUS FOR STORAGE AND SELECTION OF SUSPENDED SHEETS

This invention relates to an apparatus of the type adapted to provide for storage and selection of sheets, such as drawings and the like in suspended position.

There have been proposed apparatuses of the above type such as defined in the U.S. Pat. Nos. 2,623,526 and 2,704,545 wherein the sheets such as drawings are grouped in stacks each supported by a rack bar by a set of pins through the sheets. In these patented apparatuses, any stack of sheets is lifted by hand to register the pins thereof with the pins to effect the selection of sheets. It must be appreciated that such stack of drawings is relatively heavy and difficult to so handle particularly at the far end of the cabinet. In the patented apparatuses, the pins for the selection of sheets are pivoted lengthwise to register endwise with the pins of the lifted stack. With such pivotal movement of the pins, it is difficult to achieve accurate end to end alignment particularly after some wear shows up.

It is a general object of the present invention to provide an apparatus of the above type for the storage and selection of suspended sheets wherein a mechanism is provided to assist the lifting of any selected stack of sheets.

It is another general object of the present invention to provide an apparatus of the above type wherein the aforementioned selection pins are positively displaced and guided endwise for accurate and sturdy alignment with the pins of the selected stack of sheets.

It is a further object of the present invention to provide an apparatus of the above type which is of simple construction and reliable operation.

The above and other objects and advantages of the present invention will be better understood with reference to the following detailed description of a preferred embodiment thereof which is illustrated, by way of example, in the accompanying drawings; in which.

Figure 1:
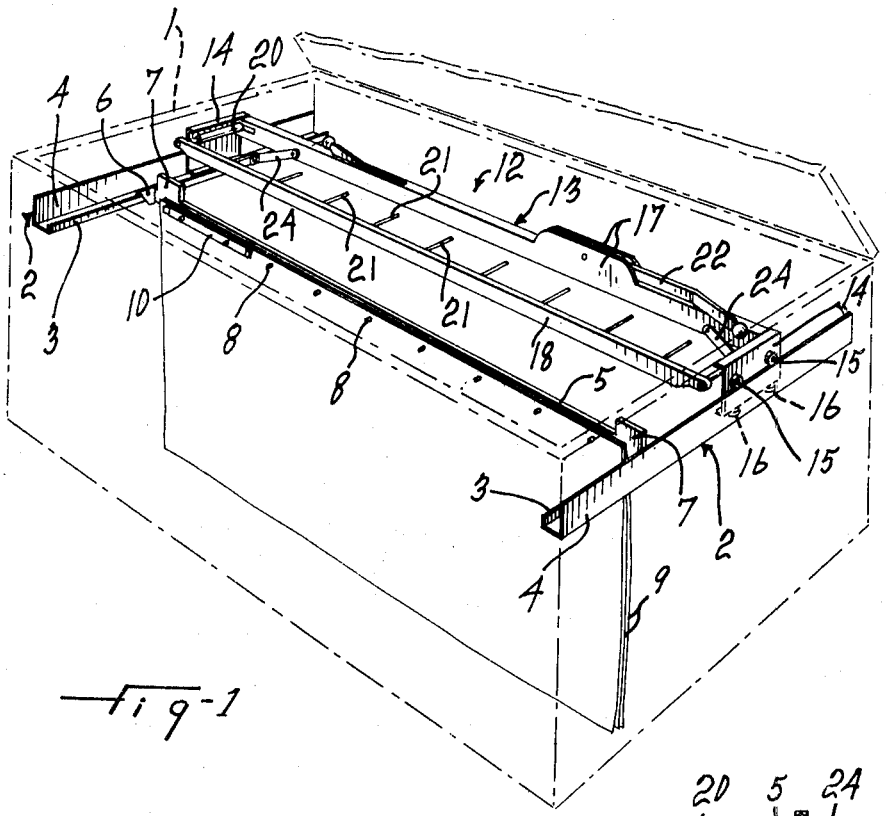
FIG. 1 is a perspective view of a storage and selection apparatus for suspended sheets accoording to the present invention.
Figure 6:
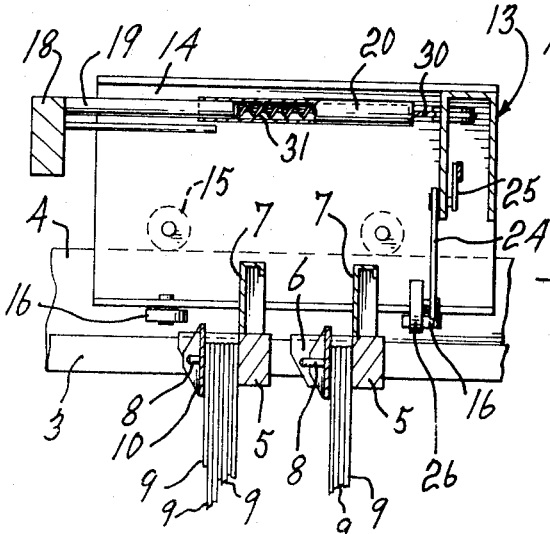
Figures 2, 3:
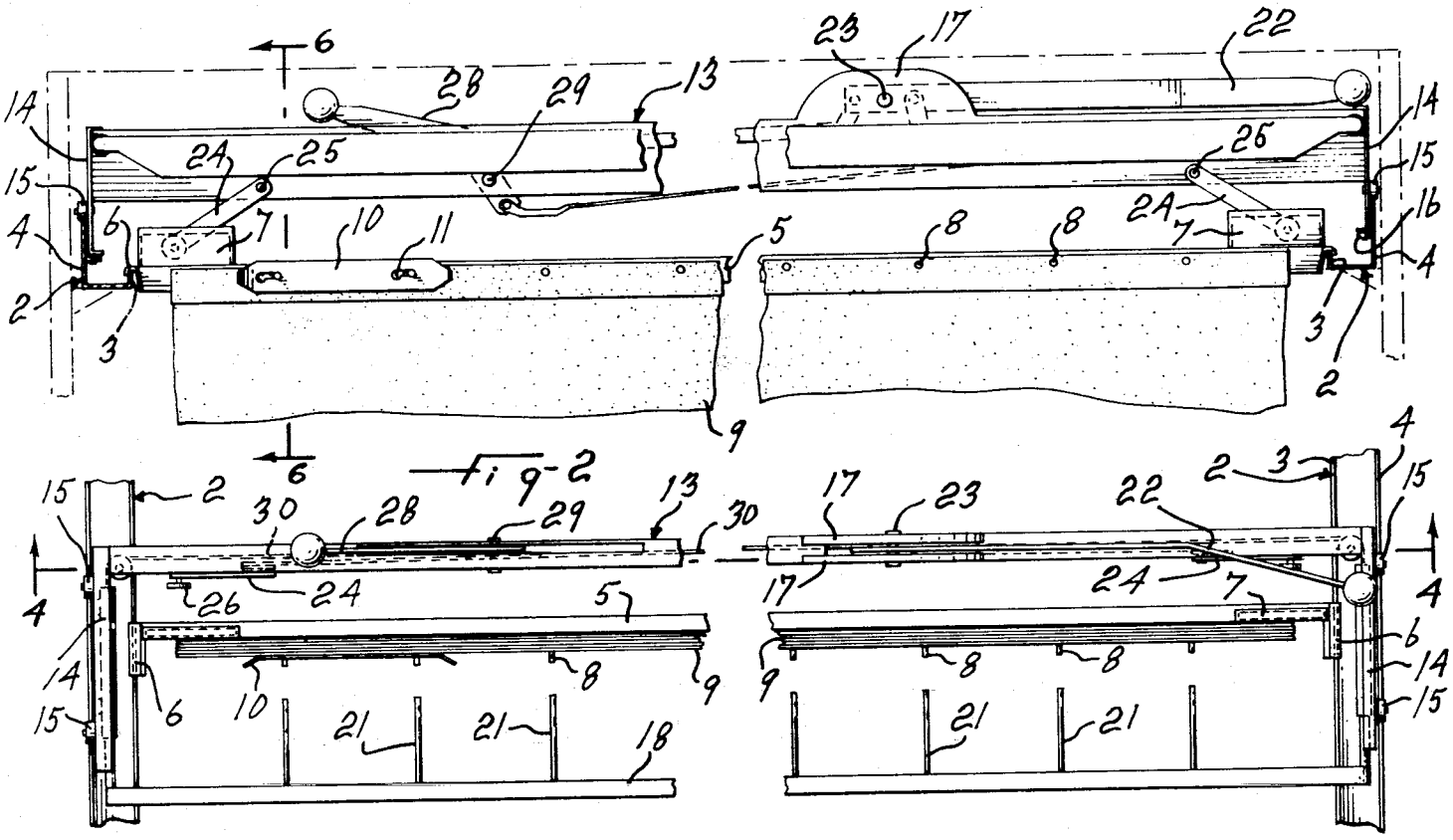
FIG. 2 is a front elevation view with parts broken away of the storage and selection apparatus of FIG. 1.
FIG. 3 is a top view of the same storage and selection apparatus.
Figure 4:
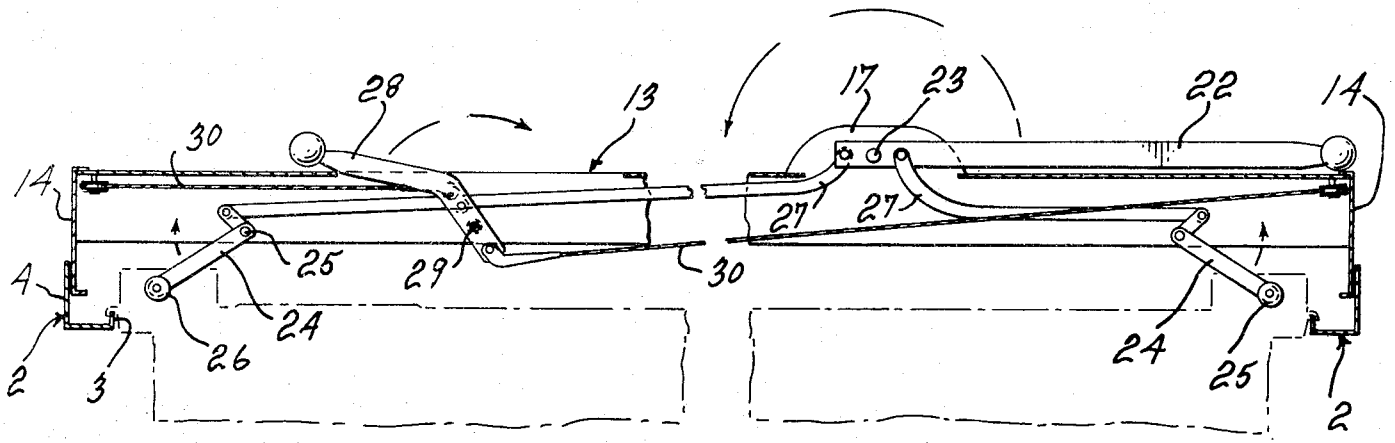
FIG. 4 is a cross-sectional view as seen along line 4—4 in FIG. 3 particularly showing a lifting mechanism in non-lifting position.
Figure 5:
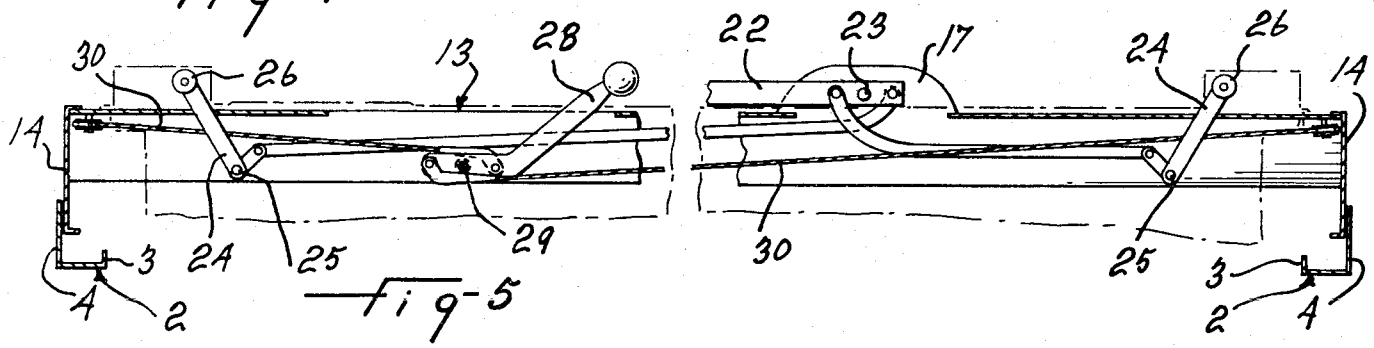

FIG. 5 corresponds to FIG. 4 but with the lifting mechanism in lifting position;

FIG. 6 is a cross-sectional view as seen along line 6—6 in FIG. 2; and

Figure 7:
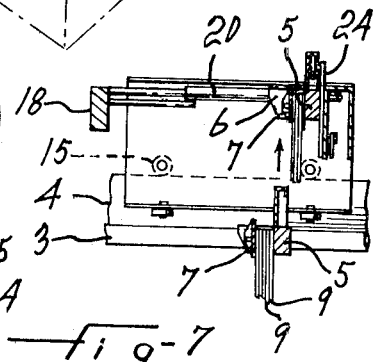
Figure 8:
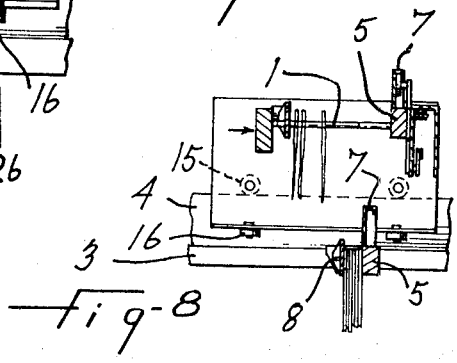

FIGS. 7 and 8 are views corresponding to FIG. 6 and sequentially showing the operation of lifting and selection of the suspended sheets.

The illustrated storage and selection apparatus is adapted to be mounted in a cabinet of any appropriate type and comprises a pair of tracks 2 mounted parallel to each other and forming guideways extending in fore and aft direction in the cabinet 1. Each track 2 has a channel shape cross-section including a low inner flange 3 and a higher outer flange 4.

A plurality of sheet suspending rack bars 5 extend longitudinally transversely relative to the guideways or tracks 2 and have their opposite ends each provided with a hook portion 6 slidably resting on the corresponding low inner flange 3. Thus, the main rack bars 5 are slidable longitudinally of the guideways or tracks 2. Each main rack bar 5 is also provided at each end with a fixed hook member 7 in the form of a rearwardly opening cavity extending some distance longitudinally of the corresponding rack bar 5. Each rack bar 5 is also provided with a predetermined series of pins 8 projecting endwise therefrom in one longitudinal direction of the gudeways. In this case, the sheet suspending pins 8 outwardly project forwardly of the cabinet 1. The pins 8 are adapted to engage in a corresponding series of holes along one edge of sheets 9, such as drawings to suspend the latter on the pins. Thus, a stack of sheets may be carried by each rack bar 5. A clamping strip or plate 10 engages a plurality of pins 8, preferably at each end of a stack of suspended sheets 9 to hold the latter on the sheet suspending pins. As shown in FIG. 2, each strip or plate 10 is provided with bayonnet type slots 11 to lockingly engage the pins 8 such as in a notch therein.

Thus the rack bars 5 allow to store a plurality of stacks of sheets in a sheet storage space between the two guideways 2.

A carriage 12 is movably mounted on the tracks 2 for to and fro displacement longitudinally of these tracks. This carriage comprises a main frame portion including a crossbeam 13 and opposite end plates 14 rigidly connected to the opposite ends of the crossbeam. One pair of rollers 15 are rotatively mounted outside each end plate 14 to rollably engage on the higher flange 4 of the corresponding guide track 2. Another pair of rollers 16 are rotatively attached to each plate 14 and rollably engage against the inside of the higher flange 4 to guide the carriage 12 laterally relative to the guide tracks 2.

The crossbeam 13 is of inverted and deep channel shape cross-section as best shown in FIG. 6 and is provided with a pair upward projections 17 of the opposite sides thereof. The carriage 12 also includes an auxiliary rack bar 18 which is mounted at its opposite ends for sliding movement to and fro relative to the main frame portion and longitudinally of the guide trays 2.

The auxiliary and movable rack bar 18 is provided at each end with a piston rod 19 which is slidable endwise in a cylinder 20 fixed to the corresponding end plate 14 of the carriage. The auxiliary rack bar 18 is also provided with a series of pins 21 projecting endwise therefrom in opposite direction relative to the aforementioned one direction of the pins 8. the pins 21 constitute sheet selection pins and are arranged in the same predetermined series as the pins 8 to register endwise with the latter.

A lifting mechanism is provided on the crossbeam 13 to selectively lift one rack bar 5 and the corresponding stack of sheets 9 to the appropriate height for horizontal endwise registry of the corresponding pins 8 with the pins 21, as shown in FIG. 8. The lifting mechanism includes a handle 22 which is pivoted at 23 between the upward projections 17 and a pair of hooking devices to lift any desired rack bar 5. Each hooking device insludes a lever 24 which is pivoted at 25 and has an idler wheel 26 on the free end thereof to hookingly engage in the cavity defined by the fixed hook member 7 at the corresponding end of the selected rack bar 5. Thus, when the desired rack bar 5 is properly positioned along the guide tracks 2, the idler wheels 26 can upwardly engage in the cavity formed by the fixed hook members 7 to lift the selected rack bar.

A pair of links or bars 27 are pivotally connected at one end to the elbow shaped levers 24 respectively and at the other end to the handle 22 on opposite sides of the later and of the axis 23 thereof. The links 27 are also crooked to achieve the proper amount of pivoting as shown in FIGS. 4 and 5. It must be noted that the handle 22 conveniently pivots longitudinally of the carriage 12 on top of the crossbeam 13 and all the pivot axis are parallel to the guide tracks 2 with the links 27 and levers 24 in the crossbeam 13.

An actuating mechanism is provided to slide the auxiliary rack bar toward endwise abutment of the sheets selection pins 21 thereof with the sheets suspending pins 8 of a lifted rack bar 5. The actuating mechanism includes a handle 28 pivoted at 29 longitudinally of the carriage. A pair of cables 30 are connected at one end to the handle 28 and at the other end to the pins 19 respectively. A return spring 31 is mounted in each cylinder 20 to outwardly bias the auxiliary rack bar 18 relative to the lifted rack bar 5, if any.

As is known in the art, a sheet or drawing may be added, removed, or inserted at any position in a stack of sheets by the aforementioned lifting of the desired stack and abutment of the pins 21 endwise with the pins 8 of the desired stack, as shown in FIG. 8. Then, the sheets 9 may be slided onto the pins 21 until the right place is found in the desired and lifted stack. The auxiliary rack bar 18 may then be released to insert or remove a sheet. The operation is then reversed to return the stack to the storage space below the carriage.

What I claim is:

1. A storage and selection apparatus for suspended sheets and comprising a pair of parallel guideways laterally spaced apart by a storage space for suspended sheets, a carriage extending over said storage space and having opposite sides engaging said guideways and displaceable along the latter, a plurality of main elongated racks extending lengthwise transversely of the guideways, having opposite ends operatively movable on the guideways respectively and having sheet suspending projections outwardly extending from one side of the racks in one longitudinal direction of said guideways, said carriage including a main frame portion and an auxiliary elongated rack extending lengthwise transversely of the guideways and having sheet suspending projections outwardly extending from one side thereof in the opposite longitudinal direction relative to said one longitudinal direction, a lifting mechanism operatively mounted on said main frame portion, selectively engaging one of said main elongated racks, and operatively lifting said one main elongated rack into endwise registry of the sheet suspending projections thereof with said sheet suspending projections of the auxiliary rack, said auxiliary elongated rack being displaceable to and fro longitudinally of said guideways relative to said main frame portion and toward and away relative to abutment of the projections thereof with the projections of said one main elongated rack, and an acutating mechanism operatively mounted on said main frame portion, connected to said auxiliary elongated rack, and operatively displacing the latter toward said abutment of the projections thereof with the projections of said one main elongated rack, whereby suspended sheets may be slided onto the projections of the auxiliary rack from the projections of said one main rack, and vice versa.

2. A storage and selection apparatus of the above type as defined in claim 1, wherein each of said main elongated racks includes fixed hook portions and said lifting mechanism includes liftable hooks, links connected to said liftable hooks respectively and a handle connected to said links, said liftable hooks selectively engaging said fixed hook portions of said one main rack and lifting said one main rack and the corresponding fixed hook portions upon actuation of said handle.

3. A storage and selection apparatus of the above type as defined in claim 2, wherein said handle is pivoted to said main frame portion about an axis extending longitudinally of said guideways, each of said liftable hooks includes a lever pivoted to said main frame portion about axes extending parallel and on opposite sides respectively of the axis of said handle, and said links are pivotally connected to said levers respectively and to said handle whereby said levers pivotally engage said fixed hook portions and lift said one main rack upon pivoting of said handle longitudinally of said carriage.

4. A storage and selection apparatus of the above type as defined in claims 1, 2 or 3, wherein said acutating mechanism includes another handle pivoted on said main frame portion and a cable system connected to said auxiliary elongated rack and operatively displacing the latter toward said abutment of the projections thereof with the projections of said one main elongated rack.

5. A storage and selection apparatus as defined in claims 1, 2 or 3, wherein said actuating mechanism includes another handle pivoted on said main frame portion about an axis extending longitudinally of said guideways, a pair of cables connected at one end to the opposite ends respectively of said auxiliary elongated rack and at the opposite end to said another handle, and springs engage the opposite ends of said auxiliary elongated racks and operatively bias the latter away from said abutment and said another handle is pivotable longitudinally of said carriage thereby pulling on said cables and producing said abutment.

* * * * *